United States Patent [19]

Hernández

[11] Patent Number: 4,498,126

[45] Date of Patent: Feb. 5, 1985

[54] LIGHTING FIXTURE WITH RELAMPING SOCKET APPARATUS

[75] Inventor: José A. Hernández, San Marcos, Tex.

[73] Assignee: Wide-Lite International Corporation, San Marcos, Tex.

[21] Appl. No.: 539,898

[22] Filed: Oct. 7, 1983

Related U.S. Application Data

[63] Continuation of Ser. No. 273,362, Jun. 15, 1981, abandoned.

[51] Int. Cl.[3] ..... F21S 3/00

[52] U.S. Cl. ..... 362/220; 362/217; 362/288; 362/289; 362/306; 362/372; 362/429

[58] Field of Search ..... 362/217, 220, 285, 288, 362/289, 296, 306, 372, 374, 375, 429

[56] References Cited

U.S. PATENT DOCUMENTS

| | | | |
|---|---|---|---|
| 1,902,026 | 3/1933 | Hall | 362/220 |
| 4,323,953 | 4/1982 | Hutchison | 362/220 |

FOREIGN PATENT DOCUMENTS

| | | | |
|---|---|---|---|
| 12830 | 7/1980 | European Pat. Off. . | |
| 225912 | 4/1969 | Sweden | 362/220 |
| 1054889 | 1/1967 | United Kingdom . | |
| 1058770 | 2/1967 | United Kingdom . | |

*Primary Examiner*—Donald P. Walsh

*Attorney, Agent, or Firm*—Vaden, Eickenroht, Thompson, Bednar & Jamison

[57] ABSTRACT

A hinged bracket for permitting the swinging away, within limits, of at least one socket to permit easy access to an elongated, doubled-ended bulb for relamping purposes, the relamping apparatus holding the bulb firmly enough to prevent its dropping out of the sockets. The sockets are each spring-loaded and partly biased against the bulb in the open relamp position and firmly biased against the bulb in the position of use. A heat sink is also provided via a sleeve extension on the socket and a mating hump on the door which provides access, when removed, to one of the bulb sockets through relatively small openings in the fixture and the nearby reflector. The swinging away of the socket to one side of these openings provides easy access to the bulb that would not otherwise be possible.

5 Claims, 5 Drawing Figures

FIG. 4
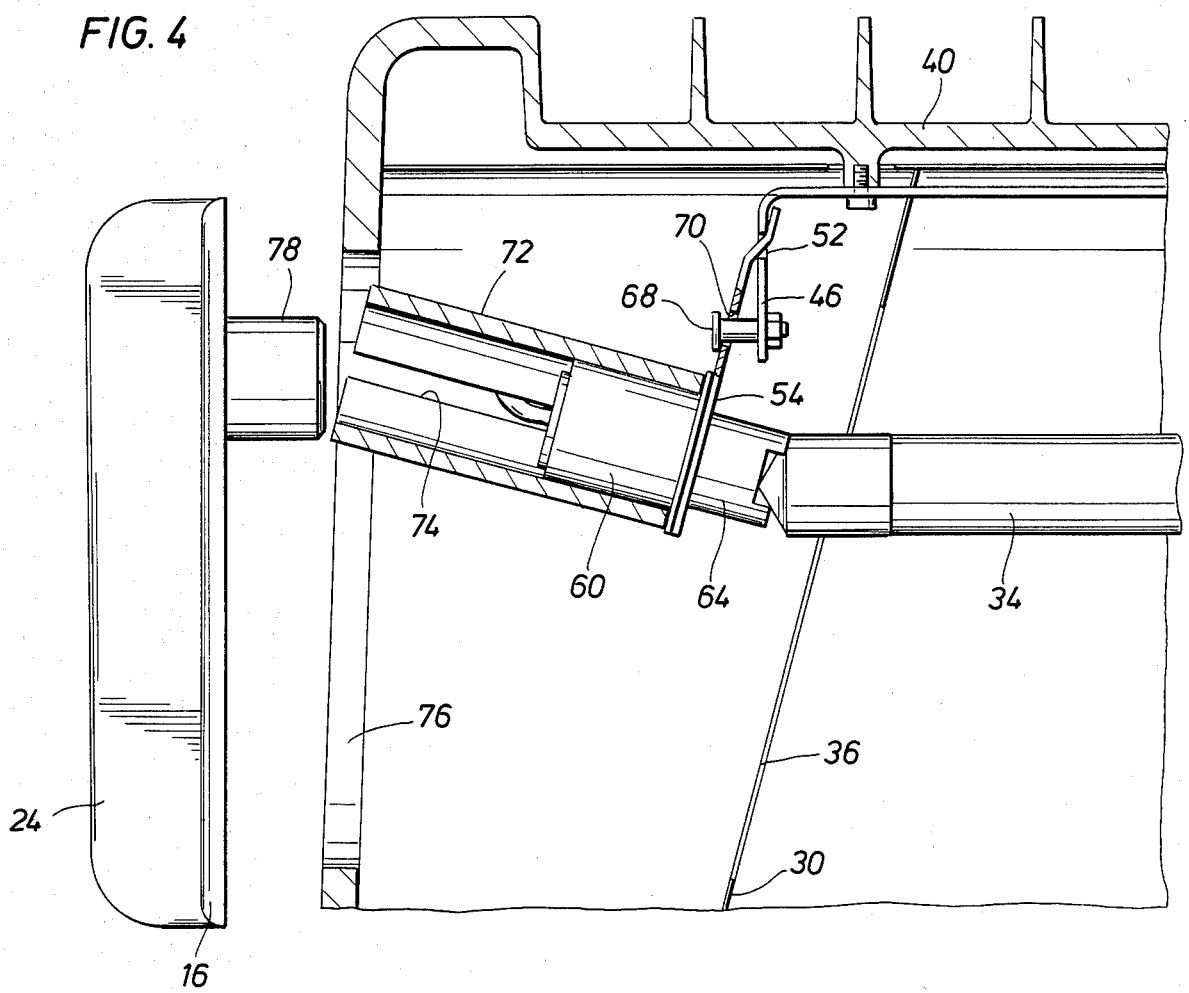
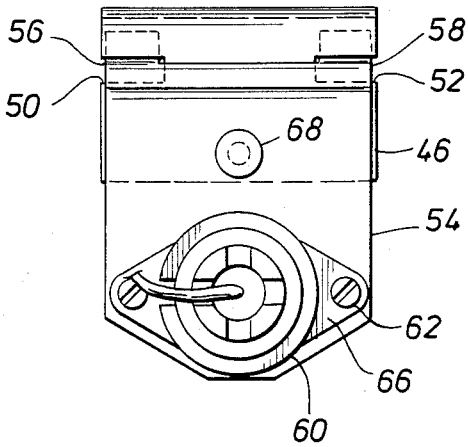
FIG. 5

LIGHTING FIXTURE WITH RELAMPING SOCKET APPARATUS

BACKGROUND OF THE INVENTION

This is a continuation of copending application Ser. No. 273,362, filed June 15, 1981, now abandoned.

1. Field of the Invention

This invention pertains to lighting fixtures and more specifically to relamping a lighting fixture through a side opening in the housing thereof.

2. Description of Prior Art

Lighting fixtures housing a high intensity discharge (HID) lamp are typically entered for relamping purposes in one of three ways: (1) through the front opening by removing or pivoting the lens cover, (2) by separating part of the housing from another part to yield access to the lamp, and (3) through an opening or hole in the side of the fixture.

The scheme of going through the front opening has two primary disadvantages. First, there is an awkwardness about removing or pivoting the lens in many installation situations. Fumbling with both a large lens and a bulb is sometimes not only inconvenient but can be hazardous. Furthermore, the lens opening of a large fixture may be some distance from the mounting bracket and, therefore, may also be difficult to easily reach.

Another difficulty sometimes encountered with front-opening fixtures is the difficulty in resealing the fixture. There are numerous ways that the lens may be held onto the fixture, but easily resealing the fixture is always a concern of the relamper.

Fixtures that provide relamping access by providing a separation of the fixture at some point other than the lens also suffer from the difficulties of effecting a satisfactory and reliable seal at the separation following relamping. Furthermore, such structures are more complex and, therefore, more expensive than other schemes.

The side door opening provides a satisfactory way of providing efficient and economic relamping in a large percentage of the cases. However, if a lamp is dropped during relamping there can be a serious problem. Furthermore, it is sometimes difficult to position both ends of a bulb into their appropriate positions or brackets or sockets when only grasping a bulb at one end. This is particularly true when the bulb has terminal connections at both ends, rather than just at one end and the bulb is long, such as with a tubular metal halide lamp or a quartz iodine lamp.

Therefore, it is a feature of the present invention to provide an improved lamp fixture providing relamping through a hole in the side of a fixture housing, wherein the bulb is easily reached and manipulated and upon release does not fall out of position.

It is another feature of the present invention to provide an improved lamp fixture relamping bracket using a connector that swings away, within limits, to provide easy and safe manipulation of the replacement bulb.

It is still another feature of the present invention to provide an improved relamp apparatus in combination with the lamp terminal connections that also provide heat sink connections.

SUMMARY OF THE INVENTION

A preferred embodiment of the invention includes a housing for an elongate tubular bulb, such as a 1500 watt metal halide bulb produced by Sylvania Electric Co., having terminal connections at either end of the bulb. Such a bulb is typically 10 1/16 inches in overall length, $\frac{7}{8}$ inches in diameter and reaches a temperature of 800° C. at its midpoint during operation (and 500° C. at each of its end terminals).

The housing for the reflector has an opening which is in a plane parallel with the elongate axis of the lamp and includes a reflector behind and at either end of the bulb within the housing.

The bracket carrying the wires and terminal connections lies between the reflector and the housing within the fixture so that access of the terminals to the connectors are via side openings in the reflectors. A relamp door covers an opening at one or both ends of the bulb (in the side(s) of the housing) to permit removal of a burned out bulb and the replacement thereof with a relamping bulb.

The connector socket at each end is mounted in a piece of the bracket that is hinged with the main portion of the bracket rigidly mounted to the housing. A stop or limit to the amount of pivot or hinge action is provided by a large-headed screw connected to the one portion of the bracket and operating in a hole larger than the screw shank in the other portion of the bracket.

The socket is joined to an elongated heat sink which contacts the relamp door when the relamp door is closed. The relamp door preferably includes a mating hump portion for contacting or close-contacting an extended length of the heat sink for carrying heat away from the socket and dissipating the heat into the housing.

The sockets at each end are internally spring-loaded so that when a relamp door is opened the spring in the opposite socket swings away the socket released for access through the opening uncovered by the removal of the door. When the socket swings away, easy access to the bulb is provided since the socket is moved to the side out of the way. The stop or limit on the bracket piece that swings away limits the amount of swing to prevent the bulb from dropping out of the sockets.

Replacement is provided by manually forcing the spring at one end and then the other further than their atrest positions. The door is then closed and secured, swinging the bracket piece and socket back to its in-use position and effecting the heat sink connection.

BRIEF DESCRIPTION OF THE DRAWINGS

So that the manner in which the above-recited features, advantages and objects of the invention, as well as others which will become apparent, are obtained and can be understood in detail, more particular description of the invention briefly summarized above may be had by reference to the embodiments thereof which are illustrated in the appended drawings, which drawings form a part of this specification. It is to be noted, however, that the appended drawings illustrate only a typical embodiment of the invention and are therefore not to be considered limiting of its scope, for the invention may admit to other equally effective embodiments.

IN THE DRAWINGS

Figure 1:
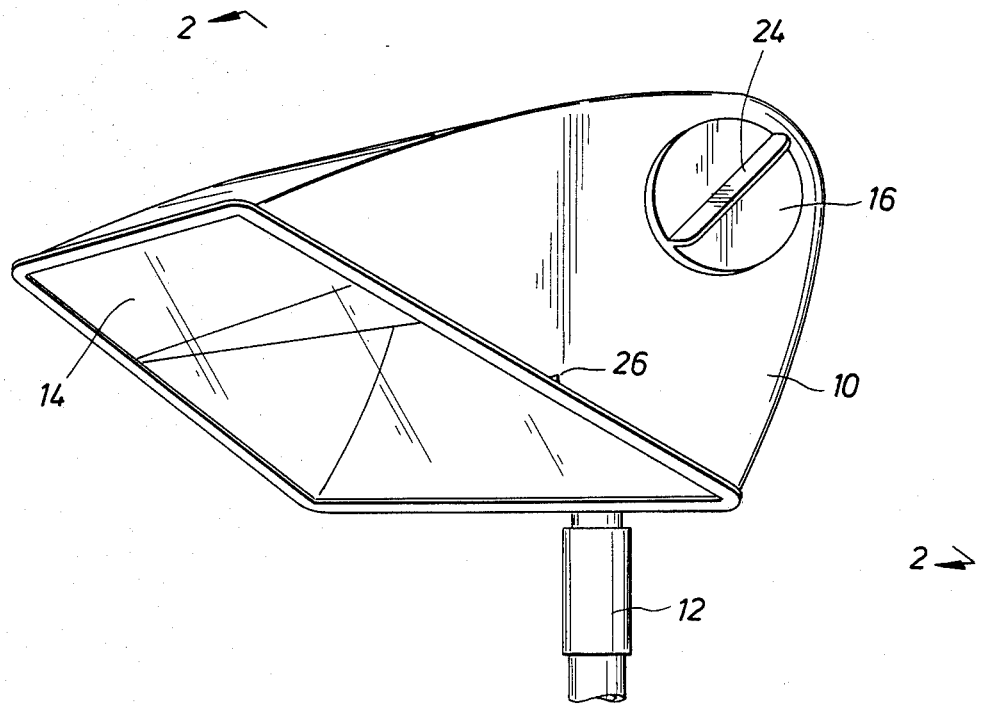

FIG. 1 is an oblique pictorial of a preferred embodiment of a light fixture in accordance with the present invention.

Figure 2:
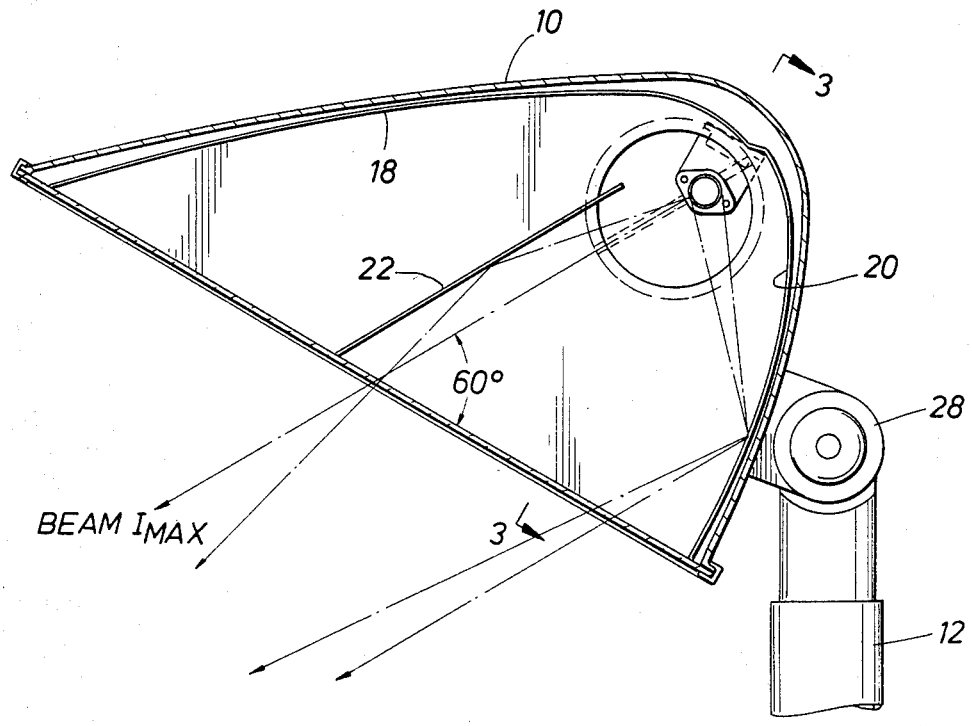

FIG. 2 is a cross-sectional view of the light fixture shown in FIG. 1 taken at line 2—2.

Figure 3:
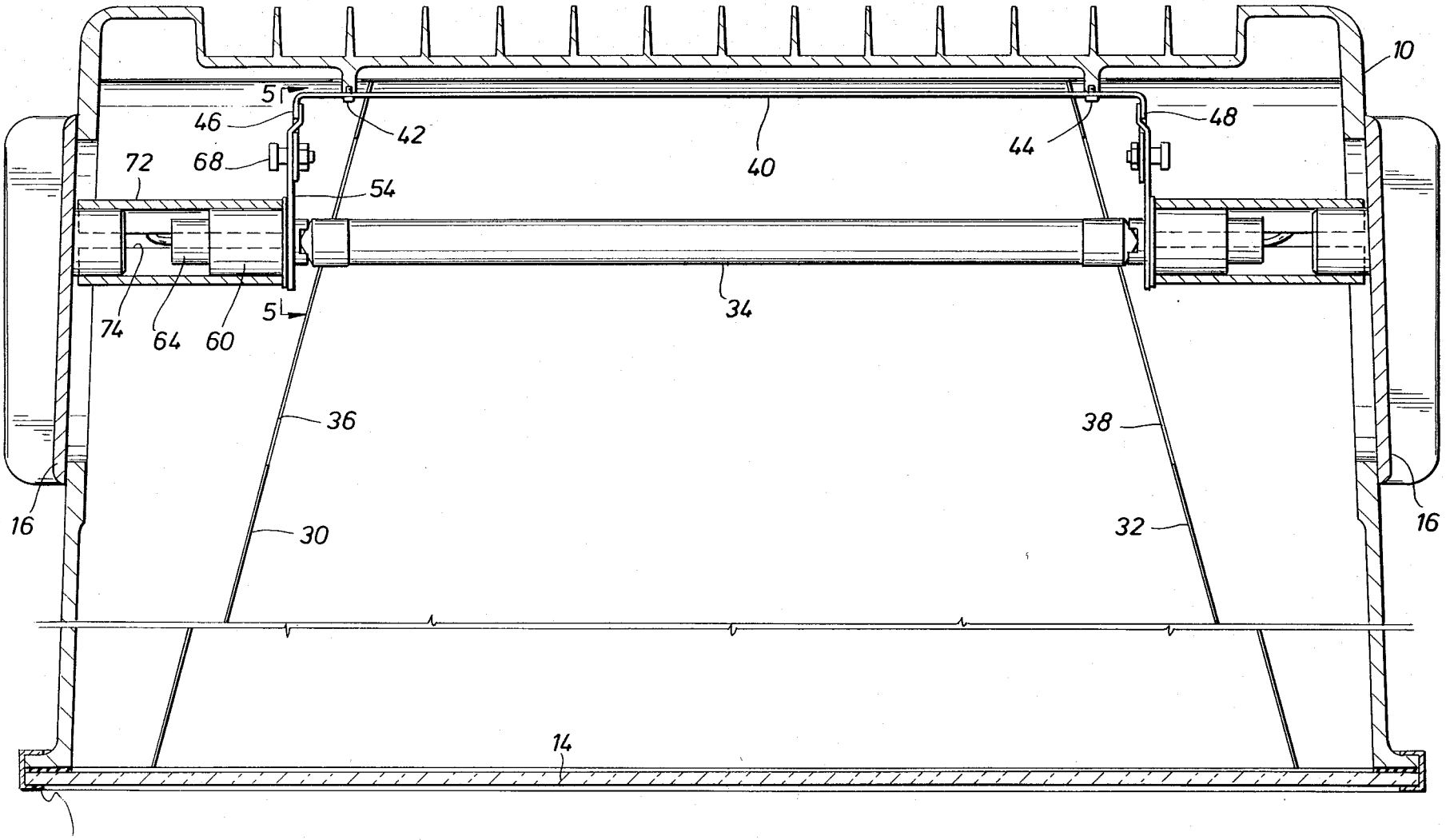

FIG. 3 is a cross-sectional view of the light fixture shown in FIG. 2 taken at line 3—3.

FIG. 4 is a cutaway view of a corner of a preferred embodiment of the light fixture in accordance with the present invention detailing the socket connection apparatus.

FIG. 5 is an end view of the socket connection apparatus taken at line 5—5 of FIG. 3.

DESCRIPTION OF THE PREFERRED EMBODIMENT

Now referring to the drawings, and first to FIG. 1, a preferred embodiment of a lighting fixture in accordance with the present invention is illustrated in an oblique pictorial. Housing 10 is shown mounted on a pole or post 12 and is angled at a typical position of use for directing light downwardly and outwardly away from the post. The lens or window 14 closing the fixture through which light from the lamp bulb shines can be either glass or a plastic film having good transmittance properties and is installed in a permanent type of installation mounting since access to the bulb for replacement or relamping purposes is not through this opening. As is described more fully hereinafter, relamping is achieved via a hole or opening in the side of the fixture closed by relamp door 16.

Now referring to FIG. 2, which is a cross-sectional view of the fixture shown in FIG. 1, housing 10 carries a reflector comprising portions 18 and 20 which together are partly behind the bulb and both of which provide reflections from the bulb outwardly through the fixture lens opening. A cutoff shield 22 is provided to prevent direct light reflections from too high an angle, the reflections for such a type of fixture being described more fully in copending U.S. patent application Ser. No. 104,011, filed Dec. 17, 1979, entitled "Reflector System Having Sharp Light Cutoff Characteristics" of the same inventor and commonly assigned, which is incorporated herein by reference for all purposes. The main direction for light from this asymmetrical fixture is set in a preferred embodiment thereof at 60° with respect to the plane of the opening and with which direction cutoff shield 22 is parallel. For ease of aiming, relamp door 16 includes an elongate handle 24 that provides a sighting or aiming function in combination with a mark 26 near the lens opening for positioning the fixture. The fixture is pivoted on post 12 and secured by swivel 28 in a manner well known in the art.

To more fully explain the bracket in accordance with the present invention, reference is now made to FIG. 3. Housing 10 includes, in addition to the reflector sections shown in FIG. 2, side reflectors 30 and 32. Although they can be at right angle with respect to window opening 14, they are preferably angled at about 68° respect thereto for reflecting light from bulb 34 mounted in the fixture as hereafter described. These side reflector sections each include an opening 36 and 38, respectively, through which the terminal ends slightly extend and which is large enough to permit relamping as hereafter explained. An opening with a diameter of 4 inches is suitable.

An elongate bracket 40 positioned between the reflector and the rear of the housing is secured to the housing via tapped mounting holes and screws 42 and 44. Although shown mounted directly opposite the opening for convenience of illustration, a preferred location for this bracket mounting would be closer to the point where swivel 28 is connected to the housing since the electrical wires lead from the housing in this vicinty.

Ends 46 and 48 of bracket 40 are inwardly turned toward the main cavity of the fixture and are side notched at notches 50 and 52. A separate mounting piece 54 with bent tongues 56 and 58 for complementarily operating within notches 50 and 52 is provided for the mounting of the connector socket. The bend in each tongue is a two-way bend to permit the separate mounting piece to be aligned substantially perpendicularly to the elongate portion of the bracket during use and to swing away therefrom at the time of relamping.

Socket 60 is connected to piece 54 via suitable screws 62 screwed through holes in the socket flange and includes a spring-loaded center or plunger 64 that moves back and forth inside the connector housing. Suitable connectors of this type include General Electric Quartzline Lampholders of the ALI 8817 series and Leviton recessed-contact quartz-iodine or tungsten-halogen lampholders No. 554. As may be seen, the socket preferably has a front flange 66 for mounting purposes, rather than a rear flange.

Ends 46 and 48 are each tapped or alternately drilled to receive the shank of a large-headed screw 68. If the end is not tapped, then a suitable self-tapping lock nut is used to secure the screw within the end of the bracket, as shown. For purposes herein, either type of connection is considered as being means for connecting the screw to the end of the bracket. Mounting piece 54 includes a fairly large hole 70 through which the shank of the screw passes and to permit piece 54 to swing away from the end piece, as best shown in FIG. 4, until it contacts head 68 and is stopped.

An elongate and tubular heat sink sleeve 72 slips over the housing of socket 60 and is snugly held on by fairly close tolerances in the relative dimensions. This avoids the problem of the heat sink sleeve inadvertently dropping off the socket. A side slit 74 is provided in sleeve 72 to permit the electrical wires from the socket to pass. In the swing-away position of the socket mounting, the end of the heat sink sleeve passes just through side opening 76 in the housing. Preferably, this opening is about 4 inches in diameter.

Relamp door 16 includes an inwardly directed hump 78 for fitting into sleeve 72. However, the fit between sleeve 72 and hump 78 is very loose so that there is no binding therebetween when the door is opened and shut.

In operation of the apparatus just described during relamping, door 16 is removed from one side of the housing. Normally, the door is held in place by mounting screws (not shown), however, the door could be screwed in, held in by locking flanges or the like. When the door is removed, the spring-loaded socket fartherest from the uncovered opening will act so as to cause piece 54 to hingedly swing away from bracket end piece 46 until it is stopped by the screw head of screw 68. Bulb 34 is still held loosely in place between the end sockets and will not fall out.

The person doing the relamping is then able to reach through openings 76 and 36 and to press bulb 34 away from near socket 60 and toward the far socket. This releases the near end of the bulb first and allows the entire bulb to be removed from the fixture through openings 36 and 76. The replacement or relamp bulb is installed by reversing the above procedure. When the bulb is released by the person doing the relamping, it is loosely held in place between the socket and does not fall out, the springs of both sockets sqeezing inwardly slightly to hold the bulb.

The door is shut over the opening so that hump 78 is in position with respect to sleeve 72. This causes mounting piece 54 to swing back to its position of use, as shown in FIG. 3, the bulb now firmly being held between the sockets. The door is secured and the fixture is aimed by using handle 24 and mark 26 on the housing.

A metal halide bulb causes the sockets to heat to about 500° C. when operating for a period of time. Heat sink sleeve 72 and hump 78 provide heat conduction away from the socket so that the heat is dissipated by the housing, which is also provided with fins for cooling purposes.

It should be noted that the fixture may be relamped from either side, although a fixture having only a single relamp door would have the same operating advantage from that side for easy access of the bulb during relamping. Furthermore, bracket 40 shown is illustrated as a single piece. Separate brackets could be used for mounting each socket, if desired. Stop or limit means for the swing-away action of piece 54 has been shown as provided by screw 68. A middle tongue with a reverse bend could be used in lieu of screw 68, if desired.

While a particular embodiment of the invention has been shown and described, it will be understood that the invention is not limited thereto since many modifications may be made and will become apparent to those skilled in the art.

I claim:

1. In combination with a lighting fixture including a housing, an elongated bulb having socket connections at both ends, and a reflector located behind and along at least one side of the bulb, the improvement of a relamping apparatus, comprising said housing and reflector having an opening in the vicinity of the socket through which a hand can be inserted with a relamping bulb to position the terminal connections of the bulb into their respective receiving sockets, a receiving socket for each of said terminal connections having a spring-loaded, movable terminal portion, a hinged mounting for said socket nearest said opening for allowing said socket to swing away with the uncovering of said opening to permit easy relamping, and limit means for said mounting to keep said sockets sufficiently close to hold said bulb therebetween without falling out when said hand is removed.

2. A lighting fixture in accordance with claim 1, and including an extension connected to said socket nearest said opening, and a door connectable to said housing for closing the opening and for pivoting said hingedly mounted socket to its position of use.

3. A lighting fixture in accordance with claim 2, wherein said extension is at least partially tubular, said door including an inwardly projecting hump for fitting into the end of said tubular extension to provide a heat sink for said socket connected to said extension.

4. A lighting fixture in accordance with claim 1, wherein said hinged mounting includes a fixed bracket including at least one cutout and a movable piece for attachably receiving said socket, said movable piece including a bent tongue for insertion into said cutout, the pressure of the opposite spring-loaded socket causing the swing away action of the movable piece with respect to the fixed bracket.

5. A lighting fixture in accordance with claim 4, where said fixed bracket is screw tapped, said movable piece has a hole opposite said screw tap, and including a large-headed screw for screwing into said screw tap, the shank of the screw passing through said hole of said movable piece so as to permit movement away from said fixed bracket as limited by contact of said movable piece with the head of said screw.

* * * * *